United States Patent [19]

Papsco et al.

[11] 4,023,686

[45] May 17, 1977

[54] DOLLY FOR MANEUVERING MODULES OF A MODULAR WALL SYSTEM

[75] Inventors: William G. Papsco; Harry Cohn, Jr., both of Portola Valley; Rufus C. Bean, Clipper Mills, all of Calif.

[73] Assignee: Papsco, Inc., Sunnyvale, Calif.

[22] Filed: Apr. 30, 1974

[21] Appl. No.: 465,523

[52] U.S. Cl. ..... 214/1 H; 52/749; 214/1 D; 214/1 SW

[51] Int. Cl.[2] ..... B25B 1/22

[58] Field of Search ..... 214/1 SW, 1 D, 1 H, 214/1 S, 653, 672, 674, 654, 377–383; 52/749

[56] References Cited

UNITED STATES PATENTS

| | | | |
|---|---|---|---|
| 2,713,433 | 7/1955 | Gardner | 214/653 |
| 2,781,920 | 2/1957 | Burington | 214/1 D |
| 2,939,590 | 6/1960 | Henry | 214/1 SW |
| 2,959,313 | 11/1960 | Bettencourt | 214/653 X |
| 3,015,402 | 1/1962 | Norton | 214/653 X |
| 3,773,202 | 11/1973 | Dutra | 214/152 X |

*Primary Examiner*—L. J. Paperner

*Assistant Examiner*—George F. Abraham

*Attorney, Agent, or Firm*—Boone, Schatzel, Hamrick & Knudsen

[57] ABSTRACT

A dolly for maneuvering, lifting and transporting removable wall modules in the erection and disassembly of a modular wall system comprises an upwardly extending A-frame pivotally secured to a triangularly shaped wheeled base frame and having a vertically extendable grip arm with a lip at its end engageable in a groove in the module ceiling channel for moving the latter into and out of operative position against the ceiling; the lower edge of the A-frame has a horizontal lift member engageable in a longitudinal groove of the modular floor channel for lifting and supporting the module in cooperation with the grip arm. The A-frame is pivotally supported on the base frame about two axes so that the module when gripped by the grip arm end plate and the lift member may be lifted off the floor and tilted rearwardly to make an acute angle with the base frame for convenience and stability in transporting the module.

6 Claims, 8 Drawing Figures

DOLLY FOR MANEUVERING MODULES OF A MODULAR WALL SYSTEM

BACKGROUND OF THE INVENTION

This invention relates to an improved dolly useful for erecting, disassembling and transporting parts or modules of a modular wall system.

The need for more efficient utilization of space in schools, auditoriums, convention halls, office buildings and the like has resulted in the development of portable space dividers and partitions which may be erected in finished rooms after installation of carpets and ceilings without damage to either and which may be removed or relocated therein as the need arises. An example of such a wall is the modular wall system described in U.S. Pat. No. 3,753,328. The modules for such walls typically measure 4 feet × 8 feet × 3 inches and weigh 150 lbs. and accordingly require at least two men to handle each module during erection and disassembly of a wall. Moreover, the modules are awkward to handle even with two men and because of the metal framing defining sharp edges and corners are occasionally the cause of injury to the workmen during erection and removal of walls. Because of the ever increasing costs of labor as well as the unavailability of manpower in maintenance crews for erecting such walls, there is need for a dolly that may be used by one man for safely and efficiently erecting and disassembling such a modular wall system. Furthermore, the increasingly stringent safety standards imposed by government regulations and the liability incurred due to injuries sustained by workers on the job make it mandatory that risk of injury in erecting modular walls be minimized.

OBJECTS AND SUMMARY

A general object of this invention is the provision of a unique module handling dolly which is manually operable by one man to conveniently and safely transport and erect heavy and bulky ceiling to floor wall modules to form a continuous wall.

In accordance with this invention a dolly is constructed to be operated by one man and to clamp, lift, tilt and transport a wall module to facilitate the erection or disassembly of a wall comprising such modules. The dolly has a front frame with vertically movable clamps that grip the top and bottom of the module through operation of hand and foot actuated levers and a wheeled base on which the front frame is pivoted for limited rearward tilting for similarly positioning a clamped module for transport.

DESCRIPTION OF PREFERRED EMBODIMENT

Figure 1:
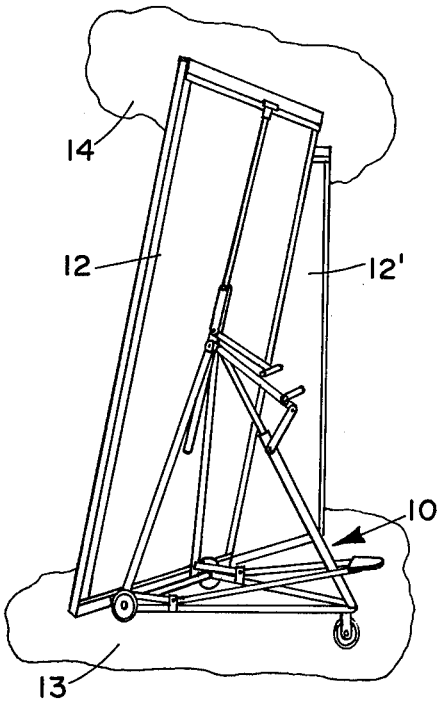
FIG. 1 is a perspective view of a wall module engaged by a dolly embodying this invention.
Figure 4:
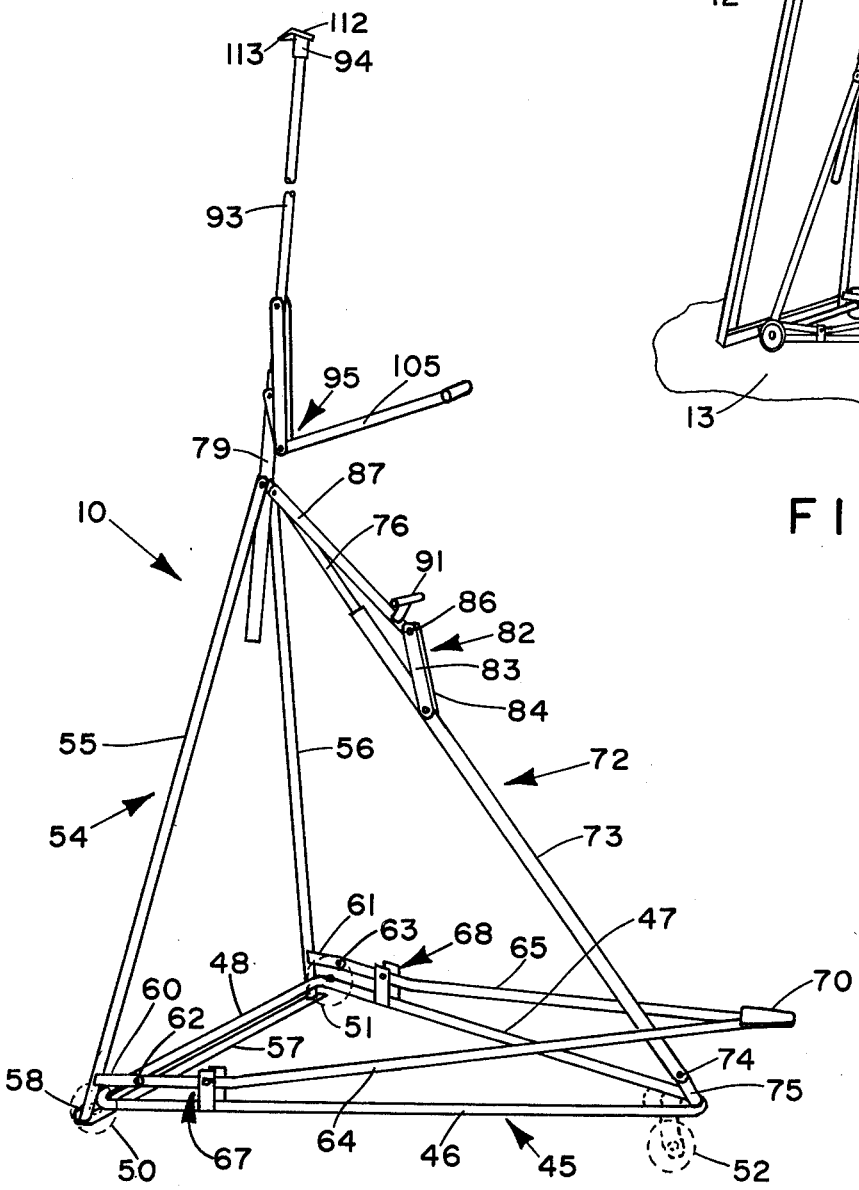
FIG. 4 is a perspective view of a dolly embodying the invention.

Referring now to the drawings, FIG. 1 shows a dolly 10 embodying this invention together with a wall module 12 which is gripped by and loaded on the dolly adjacent to a similar module 12' in an erected position and forming part of a modular wall system. In order to enable a better understanding of the dolly construction and the function of its parts to be described below, a brief description of module 12 is now presented; the module is more completely described in the copending application of W.G. Papsco et al., Ser. No. 465,524, U.S. Pat. No. 3,967,420, assigned to the assignee of this invention.

Figure 3:
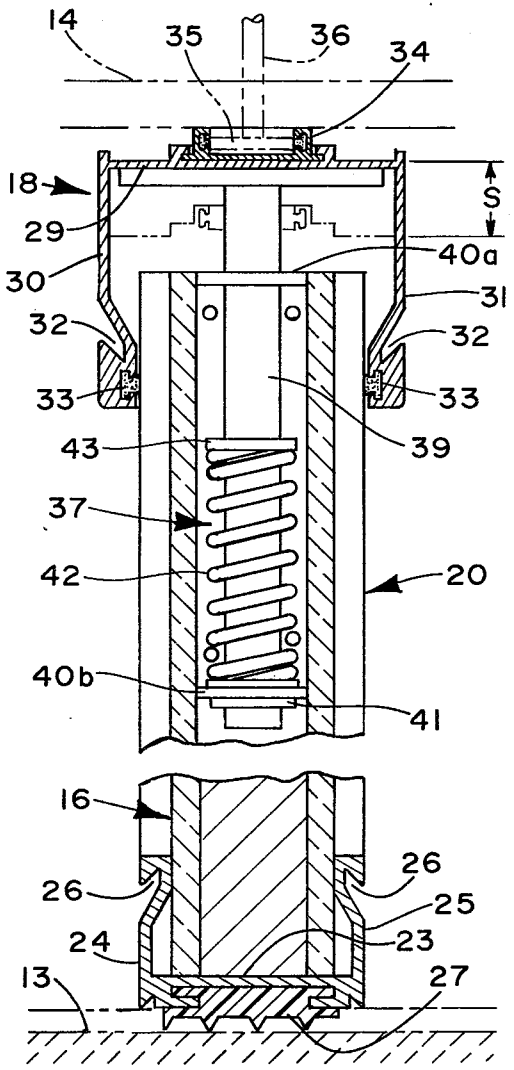
FIG. 3 is a vertical section taken on line 3—3 of FIG. 2.
Figure 2:
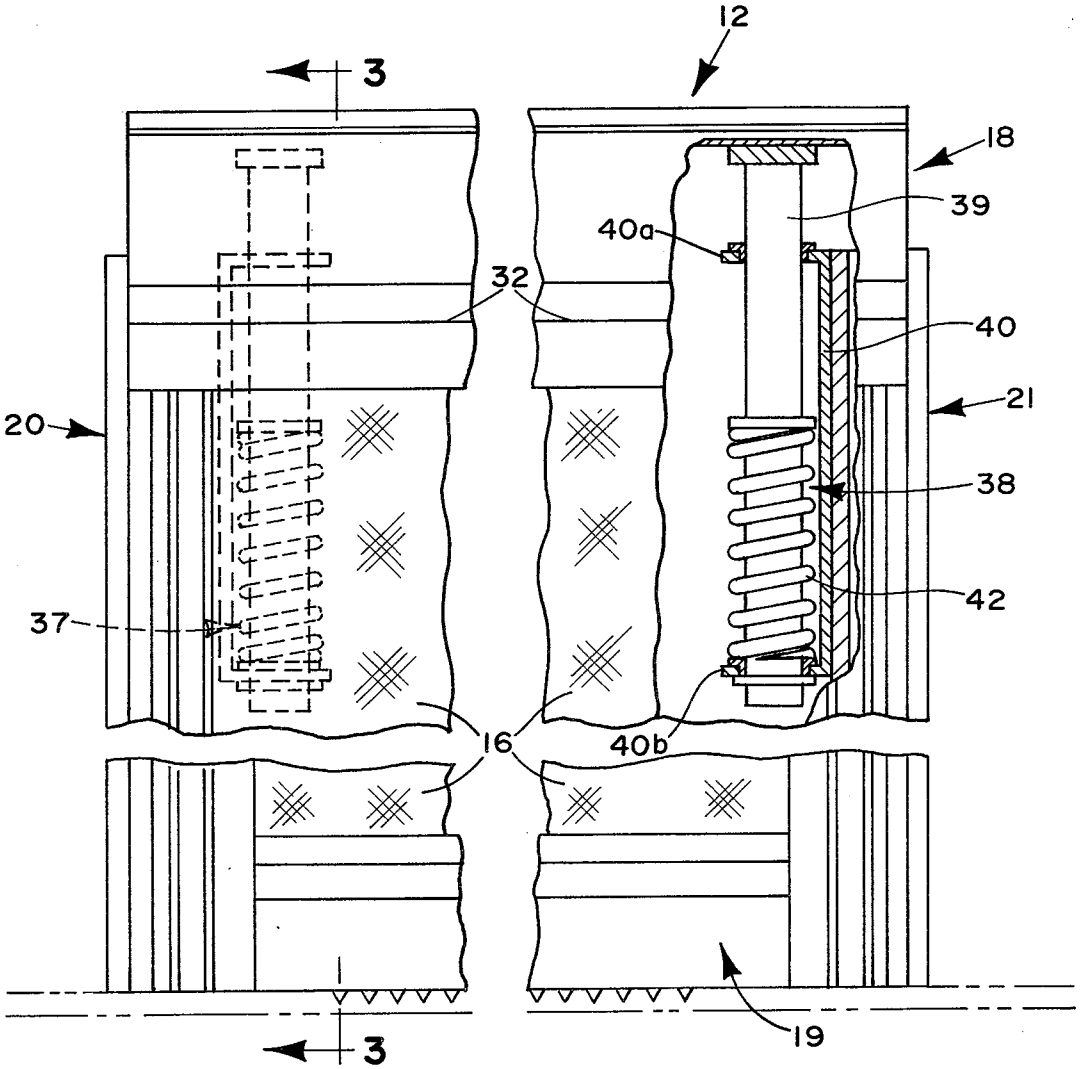
FIG. 2 is a fragmentary side elevation of a module illustrative of a construction with which a dolly embodying the invention may be used.

Referring now to FIGS. 2 and 3, module 12 is adapted to extend vertically between the floor 13 and ceiling 14 and together with other like modules with which it is arranged in end-to-end abutting relationship forms a modular wall. Module 12 comprises a main body portion or panel 16, a ceiling channel 18 and a floor channel 19 telescoped over the upper and lower edges, respectively, of the panel, and vertically extending posts 20 and 21 telescoped over and secured to the side edges of the panel.

Floor channel 19 has a bottom wall 23 and upwardly extending side walls 24 and 25, each of which is formed with longitudinally extending downwardly and outwardly opening slot 26 at the upper end. A gripper plate 27 slidably interlocked with the underside of the channel insures efficient friction coupling with the floor covering.

Ceiling channel 18 has a top wall 29 and depending side walls 30 and 31 each of which is formed with a longitudinally extending upwardly and outwardly opening slot 32 near the lower end and an antifriction fabric 33 secured to the inner surface for sliding contact with the upper portions of posts 20 and 21. A channel-shaped guide strip 34 projecting up from top wall 29 is adapted to engage a longitudinal strap 35 secured to the bottom of ceiling tile hanger support 36.

Ceiling channel 18 is supported at opposite ends on posts 20 and 21 by identical spring assemblies 37 and 38, one of which, assembly 37, is now described, like reference characters indicating like parts on the drawings. Assembly 37 comprises a vertically disposed rod 39 secured to the underside of top wall 29 and guided for vertical movement by a guide member 40 secured to the inside of post; member 40 has upper and lower wings **40*a* and 40*b* with bearing-lined openings through which rod 39 passes. A lock washer 41 axially adjustably fixed to rod 39 under wing 40*b* limits upward movement of the rod and ceiling channel. A spring 42 disposed coaxially of rod 39 between lower wing 40*b* and an upper lock washer 43** biases the rod upwardly. These springs permit the ceiling channel to be retracted from and urged against the ceiling through a distance S.

Dolly 10 comprises a triangularly shaped tubular base frame 45 having side legs 46 and 47 and a front leg 48 and supported on fixed axis wheels 50 and 51 at the ends of the front leg and on a caster 52 under the intersection of the side legs. Disposed in front of base frame front leg 48 and extending upwardly is triangularly shaped A-frame 54 comprising upwardly extending converging tubular legs 55 and 56 and a horizontal angle-shaped bar-type bottom leg 57 having an upwardly and outwardly projecting front lip 58.

Upper legs 55 and 56 of the A-frame 54 have short rearwardly extending stubs 60 and 61, respectively, rigidly secured thereto proximate to and above the front ends of base frame side legs 46 and 47, respectively. Stubs 60 and 61 are equal in length and are pivotally connected at their rear ends by pivot pins 62 and 63, respectively, to the front ends of lift bars 64 and 65. Pins 62 and 63 define the axis about which the A-frame 54 and associated structure pivots between vertical and tilted positions. Bars 64 and 65 are supported near their front ends on and slightly above base frame legs 46 and 47, respectively, by pivot connectors 67 and 68, respectively; the portions of bars 64 and 65 behind pivot connectors 67 and 68 are bent upwardly at approximately 30° and converge to a connection behind the base frame. A foot pedal 70 secured on top of the intersection of lift bars 64 and 65 permits them to be rocked vertically about their pivots to raise and lower the A-frame 54.

A diagonal brace assembly 72 interconnects the rear apex of base frame 45 and the upper apex of A-frame 54. Assembly 72 comprises a tubular member 73 extending between lift bars 64 and 65 and pivotally connected at its lower end 74 to an upwardly and forwardly inclined stub 75 secured to the base frame, and a rod 76 telescoped and axially movable within the upper open end of member 73. Rod 76 is pivotally connected at its front end by pin 77 to a stub 78 secured to an upwardly extending sleeve 79; the upper ends of A-frame legs 55 and 56 are also rigidly secured by rivets 80 or the like to sleeve 79 adjacent to stub 78.

Figure 7:
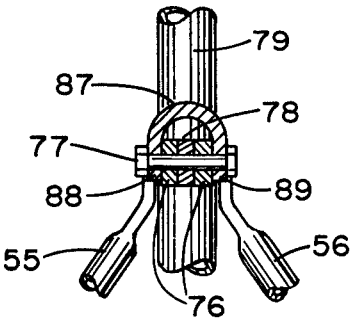
FIG. 7 is a section taken on line 7—7 of FIG. 5.
Figure 6:
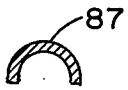
FIG. 6 is a section taken on line 6—6 of FIG. 5.

In order to change the length of brace assembly 72 and thereby pivot the A-frame forwardly and rearwardly about pivot pins 62 and 63, a lever 82 is provided. Lever 82 comprises a pair 83 and 84 of flat rear links pivotally connected at one end by pin 85 to opposite sides of brace member 73 and at the opposite end by pin 86 to a front link 87 having an arcuate cross-section, see FIG. 6. The forward end of link 87 has downwardly extending ears 88 and 89, see FIG. 7, which straddle and are pivotally connected to stub 78 by pin 77. A handle 91 on link 87 facilitates manual actuation of this lever. When handle 91 is pulled outwardly, rod 76 moves into member 73 and the A-frame 54 tilts backwardly over the base frame; when the handle is pushed inwardly, rod 76 moves out from member 73 and the A-frame pivots into a vertical position.

Figure 8:
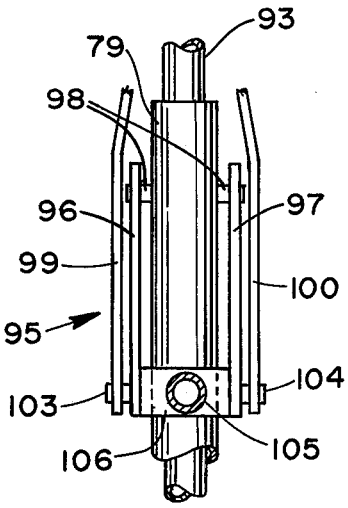
FIG. 8 is a view taken along line 8—8 of FIG. 5.
Figure 5:
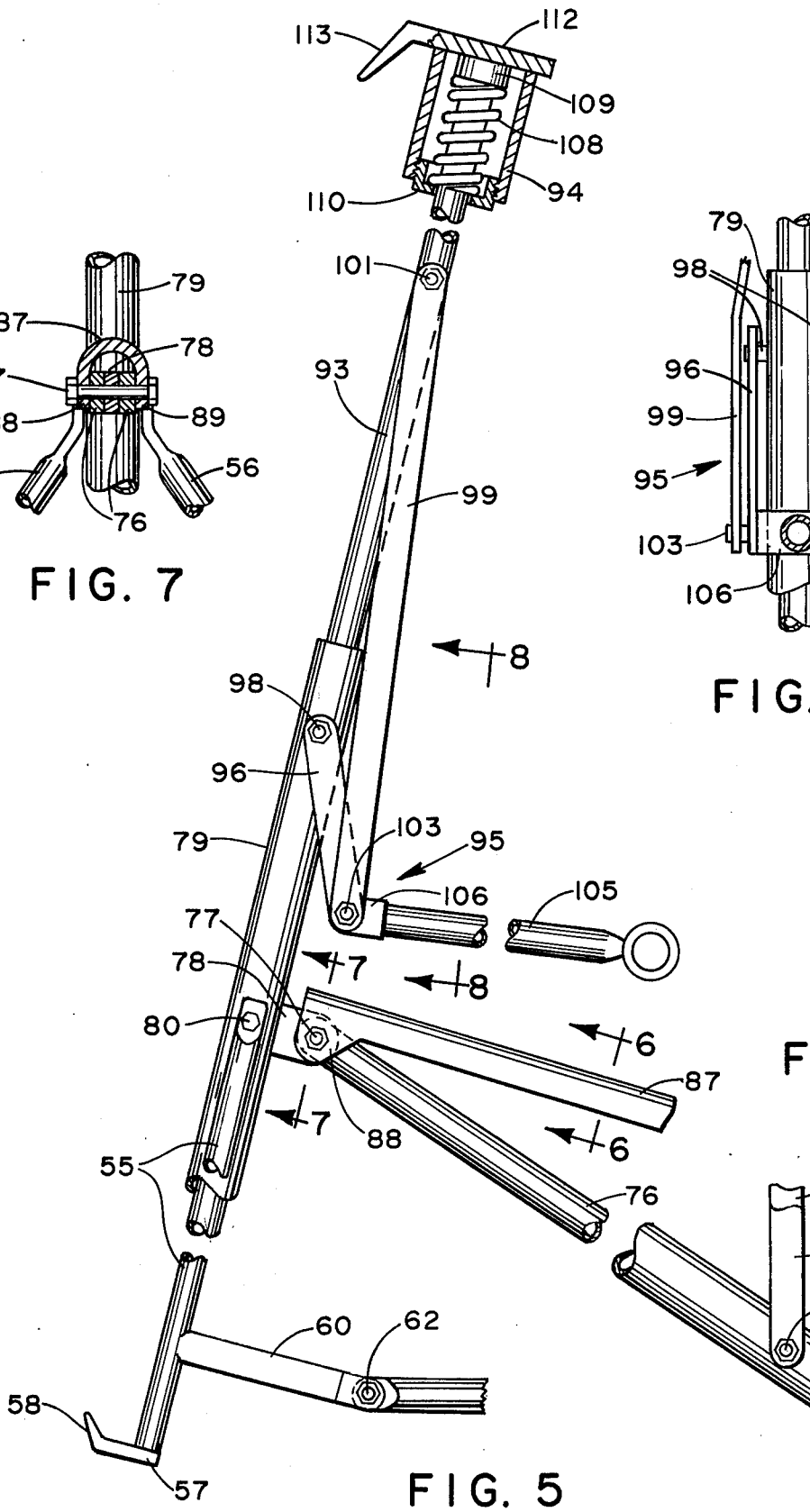
FIG. 5 is an enlarged fragmentary elevation of the front part of the dolly.

Projecting upwardly from the open upper end of sleeve 79 and axially movable therewithin is a tubular arm 93 having a head 94 nonrotatably and resiliently connected at the upper end. Arm 93 is extended from and contracted into sleeve by a lever 95 comprising a pair of laterally spaced short links 96 and 97, see FIG. 8, pivotally connected to opposite sides of sleeve 79 by pins 98, and a pair of long links 99 and 100 pivotally connected to arm 93 by pin 101. Short links 96 and 97 extend within long links 99 and 100 and are pivotally connected thereto by pins 103 and 104. A handle 105 integrally connected to links 96 and 97 by bracket 106 operates the lever. When handle 105 is pivoted upwardly, arm 93 and head 94 are extended upwardly; when the handle is pivoted downwardly, arm 93 and head 94 are moved downwardly until link pins 103 and 104 cross over the line of pins 98 and 101 in the manner of a toggle to safely lock the lever in the clamped state.

Head 94 preferably is resiliently connected to the top of arm 93 by spring 108 within the head and abutting a plug 109 on the end of arm 93 and an apertured cap 110 threadedly connected to the lower end of the head. Means, not shown, are provided to prevent rotation of head 94 on arm 93.

A plate 112 is secured to the top of head 94 and has a downwardly and outwardly extending lip 113 adapted to engage in slot 32 in the side wall 31 of module ceiling channel 18.

In operation, a module 12 is loaded on dolly 10 as shown in FIG. 1 for transport to the site of erection of the wall; in the loaded position as shown, A-frame 54 is in the rearwardly tilted position with lever handle 91 pulled out, with lip 58 on bottom A-frame leg 57 engaged in module floor channel groove 26, lip 113 of head plate 112 in groove 32 of module ceiling channel 18 under spring pressure with handle 105 of lever 95 pivoted downwardly. The module is thus securely clamped on the dolly and elevated off the floor.

At the wall site, the wall line position on the floor is determined visually either with or without aligning aids, and brace lever handle 91 is pulled up causing the module to pivot forwardly on the A-frame about pivot pins 62 and 63. As the module moves toward the vertical position, the floor channel 24 including gripper plate 27 engages the floor and the full weight of the module transfers to the floor as the module reaches the vertical plane. If the module alignment needs adjustment, the operator depresses pedal 70 sufficiently to elevate the module slightly off the floor and the dolly is maneuvered until that ajustment is made. Foot pedal 70 is then released and the module again rests on the floor in correct alignment with the wall line and slightly longitudinally spaced from the adjacent module.

Next, handle 105 of lever 95 is pivoted upwardly to move arm 93 and head 94 upwardly permitting lip 113 to allow ceiling channel 18 to move upwardly under pressure of springs 42 into light engagement with the ceiling. After channel 18 reaches its upper limit of movement, handle 105 is pivoted upwardly another increment thereby freeing lip 113 from ceiling channel groove 32. The module is then moved longitudinally of the floor into engagement with the adjacent module. The dolly is removed and the operation is repeated with additional modules to complete the wall.

By following essentially the reverse procedure, the modular wall may as readily be disassembled by one man with the dolly 10.

What is claimed is:

1. A dolly movable over floor means comprising a base frame, means for supporting said frame for movement over said floor means, a front frame extending upwardly from and pivotally supported on the front part of said base frame for pivotal movement between a first plane perpendicular to said floor means and a second plane inclined to the floor means rearwardly over said base frame, bottom lip means on the lower end part of said front frame and projecting forwardly therefrom, a variable length brace interconnecting the upper part of said front frame and the rear part of said base frame, means for raising and lowering said front frame relative to said base frame whereby to raise and lower said bottom lip means relative to said floor means comprising rearwardly extending lever means pivotally supported on said base frame, said lever means being pivotally connected at the forward end thereof to said front frame, said pivotal connection of said lever means to said front frame defining the axis of pivotal movement of said front frame relative to said base frame between said first and second planes, an extendible and contractible arm projecting upwardly from said front frame, said arm having top lip means projecting forwardly therefrom and defining with said bottom lip means a gripping plane, and means for extending and contracting said arm.

2. The dolly according to claim 1 in which said pivotal connection of said lever means to said front frame is forwardly of the location of the pivotal support of the lever means on the base frame.

3. A dolly movable over floor means comprising a triangularly shaped base frame, means for supporting said frame for movement over said floor means, a front frame extending upwardly from and pivotally supported on the front part of said base frame for pivotal movement between a first plane perpendicular to said floor means and a second plane inclined to the floor means rearwardly over said base frame, said front frame having upwardly converging upper legs and a bottom leg connecting the lower ends of the upper legs, said bottom leg having a forwardly projecting front edge constituting a bottom lip on said front frame, a variable length brace interconnecting the upper part of said front frame and the rear part of said base frame, an upwardly extending sleeve rigidly secured to and between the top ends of said upper legs, an extendible and contractible arm projecting upwardly from said front frame, said arm being slidably movable within said sleeve and having top lip means projecting forwardly therefrom and defining with said bottom lip a gripping plane, and means for extending and contracting said arm comprising a lever operably connected between said sleeve and said arm.

4. A dolly movable over floor means comprising a triangularly shaped base frame, means for supporting said frame for movement over said floor means, a front frame extending upwardly from and pivotally supported on the front part of said base frame for pivotal movement between a first plane perpendicular to said floor means and a second plane inclined to the floor means rearwardly over said base frame, said front frame having upwardly converging upper legs and a bottom leg connecting the lower ends of the upper legs, said bottom leg having a forwardly projecting front edge constituting a bottom lip on said front frame, a variable length brace pivotally connected at opposite ends to the upper part of said front frame and the rear part of said base frame, said brace comprising a tubular member and a rod movable within said member and a lever interconnecting said rod and said member for relatively moving same whereby to pivot the front frame between said first and second planes, an extendible and contractible arm projecting upwardly from said front frame, said arm having top lip means projecting forwardly therefrom and defining with said bottom lip means a gripping plane, and means for extending and contracting said arm.

5. A dolly movable over floor means comprising a triangularly shaped base frame, means for supporting said frame for movement over said floor means, a front frame extending upwardly from and pivotally supported on the front part of said base frame for pivotal movement between a first plane perpendicular to said floor means and a second plane inclined to the floor means rearwardly over said base frame, said front frame having upwardly converging upper legs and a bottom leg connecting the lower ends of the upper legs, said bottom leg having a forwardly projecting front edge constituting a bottom lip on said front frame, lever means for raising and lowering said front frame comprising first and second lift bars connected to the forward ends to the lower parts of said upper legs, respectively, and converging rearwardly to a common junction, and means for pivotally connecting said lift bars near said forward ends to adjacent parts of said base frame, a variable length brace interconnecting the upper part of said front frame and the rear part of said base frame, an extendible and conractible arm projecting upwardly from said front frame, said arm having top lip means projecting forwardly therefrom and defining with said bottom lip means a gripping plane, and means for extending and contracting said arm.

6. A dolly movable over floor means comprising a triangularly shaped base frame, means for supporting said frame for movement over said floor means, a front frame extending upwardly from and pivotally supported on the front part of said base frame for pivotal movement between a first plane perpendicular to said floor means and a second plane inclined to the floor means rearwardly over said base frame, said front frame having upwardly converging upper legs and a bottom leg connecting the lower ends of said upper legs, said bottom leg having a front edge constituting a bottom lip projecting forwardly from said frame, a variable length brace interconnecting the upper part of said front frame and the rear part of said base frame, an extendible and contractible arm projecting upwardly from said front frame, said arm having top lip means projecting forwardly therefrom and defining with said bottom lip a gripping plane, and means for extending and contracting said arm.

* * * * *